US008890437B2

(12) United States Patent
Chakravarti et al.

(10) Patent No.: US 8,890,437 B2
(45) Date of Patent: Nov. 18, 2014

(54) METHOD AND SYSTEM OF AUTOMATICALLY ADJUSTING LIGHT INTENSITY OF A LIGHTING FIXTURE HAVING MULTIPLE EMITTERS

(71) Applicant: Ledzworld SDN. BHD, Penang (MY)

(72) Inventors: Deepak Ken Chakravarti, Penang (MY); Say Joo Ng, Penang (MY)

(73) Assignee: Ledzworld SDN BHD, Penang (MY)

( * ) Notice: Subject to any disclaimer, the term of this patent is extended or adjusted under 35 U.S.C. 154(b) by 0 days.

(21) Appl. No.: 13/712,815

(22) Filed: Dec. 12, 2012

(65) Prior Publication Data

US 2014/0159613 A1 Jun. 12, 2014

(51) Int. Cl.

| | |
|---|---|
| ***H05B 37/02*** | (2006.01) |
| ***H05B 39/04*** | (2006.01) |
| ***H05B 41/36*** | (2006.01) |
| ***G05F 1/00*** | (2006.01) |
| ***H05B 33/08*** | (2006.01) |

(52) U.S. Cl.

CPC ..... *H05B 37/02* (2013.01); *H05B 33/086* (2013.01); *H05B 33/0872* (2013.01)

USPC ..... 315/297; 315/307

(58) Field of Classification Search

CPC ..... H05B 33/0815; H05B 33/0818; H05B 33/0851; H05B 37/029; H05B 41/3927; H05B 41/28; B23K 9/0671; B23K 9/0732

USPC ..... 315/297, 294, 307, 301

See application file for complete search history.

(56) References Cited

U.S. PATENT DOCUMENTS

| | | | | |
|---|---|---|---|---|
| 6,441,558 | B1 * | 8/2002 | Muthu et al. | 315/149 |
| 6,614,191 | B2 * | 9/2003 | Van Lydegraf | 315/291 |
| 7,173,383 | B2 * | 2/2007 | Vornsand et al. | 315/291 |
| 8,476,844 | B2 * | 7/2013 | Hancock et al. | 315/307 |
| 2004/0218387 | A1 * | 11/2004 | Gerlach | 362/231 |
| 2012/0159584 | A1 * | 6/2012 | Pizot et al. | 726/5 |
| 2013/0057163 | A1 * | 3/2013 | Sutardja et al. | 315/185 R |
| 2013/0207559 | A1 * | 8/2013 | Ferrier, Herman | 315/192 |

* cited by examiner

*Primary Examiner* — Dylan White

(74) *Attorney, Agent, or Firm* — Mannava & Kang, P.C.

(57) ABSTRACT

A system for automatically adjusting light intensity of a lighting fixture having multiple emitters, includes a power supply for supplying at least one current source to multiple emitters, at least one first emitter capable of emitting light of a first wavelength, at least one second emitter capable of emitting light of a second wavelength and a luminous intensity adjusting circuit for adjusting light intensity of the at least one first emitter. Particularly, the luminous intensity adjusting circuit stabilizes a first current distributed from a feeding current of the at least one current source and the multiple emitters collectively emit light at a predefined variable light-intensity.

25 Claims, 3 Drawing Sheets

METHOD AND SYSTEM OF AUTOMATICALLY ADJUSTING LIGHT INTENSITY OF A LIGHTING FIXTURE HAVING MULTIPLE EMITTERS

BACKGROUND OF THE INVENTION

1. Field of the Invention

Embodiments of the present invention relate to automatically adjusting the light colour of emitters, and more particularly, to methods and systems for automatically adjusting light intensity of multiple emitters that collectively emit light at a predefined light-intensity.

2. Description of the Related Art

Conventional light sources that have been used since a long period of time most commonly include either incandescent or gas discharge. Currently, the utilization of regular incandescent lamps having a filament is slowly reducing. There are one or more factors for this, but the most important factor is the impact on surrounding environment. Incandescent lamps have poor energy efficiency, i.e. most of the energy fed to the filament is converted to heat. Particularly, most of the input energy of traditional lighting is wasted as heat or infrared (non-visible) light in the environment. Only about 5% of the energy produces radiation in the visible range, i.e. light. Moreover, the lifetime of the incandescent bulb is limited and when failure occurs it is disastrous. The use of normal incandescent lamps is thus reduced in favour of low energy lamps, such as halogen incandescent lamps, fluorescent lamps and also LED lamps.

Traditional fluorescent bulbs have a longer life, but have significant performance variations across a range of temperatures. At some colder temperatures fluorescent bulbs do not function at all. Halogen light sources are a slight improvement in efficiency and lifetime over incandescent light sources for a marginal increase in cost.

As it is well known, in various countries, some varieties of incandescent lamps are even banned from the market in order to force the customers to choose more energy-efficient light sources. The wavelength spectrum of regular low energy lamps, i.e. of fluorescent lamps and also LED lamps is more or less acceptable for the human eye.

In recent times, the specific driver of the lamps brings about an extremely high power factor which, depending on the specific model, lies between 0.85 and 0.93, higher than any other lamp available in the market today. However, due to this high power factor, the lamps hardly cause any reactive power (VAR), a problem that many LED applications still have. Moreover, the lamps consume 80-90% less energy than traditional lamps and even 50% less than average electricity-saving lamps (compact fluorescent lamps, also known as CFL).

Currently, a known problem with light that stems from light emitting diodes is that when the light-intensity of the light emitted by the LEDS is diminished by reason that the level of the current that flows through the LEDS is lowered, the colour of the light does not shift to red in the light-spectrum as it occurs with the lowering of conventional light sources such as light bulbs. Consequently, the light-colour of such dimmed LEDs remains at its original level and subsequently, the light from dimmed LEDs is experienced as being unnatural or even unpleasant to human eye. At some wavelengths (near the color amber) changes of 2-3 nanometres (nm) are discernible to the human eye and at other wavelengths (near the color red) changes of 20-25 nm are required before the human eye can differentiate a color shift. The intensity change with temperature is discernible as well.

Accordingly, there remains a need in the art for light emitting diodes (LEDs) emitting light at a predefined variable light-intensity depending on a level of a feeding-current supplied by a current source.

Accordingly, there exists a need in the art for methods and systems for improving the natural feeling experienced by the human eye when illumination is performed by LEDs, and particularly the LEDs that reduce their level of light-intensity, such that the light that originates from such light emitting diodes shifts to warmer colours, which address the limitations of the prior art.

SUMMARY OF THE INVENTION

Embodiments of the present disclosure, generally, disclose a system for automatically adjusting light intensity of a lighting fixture having multiple emitters, includes a power supply for supplying at least one current source to multiple emitters, at least one first emitter capable of emitting light of a first wavelength, at least one second emitter capable of emitting light of a second wavelength and a luminous intensity adjusting circuit connected to the at least one first emitter for adjusting light intensity of the at least one first emitter. Particularly, the luminous intensity adjusting circuit stabilizes a first current distributed from a feeding current of the at least one current source and the first current flowing through the at least one first emitter and the multiple emitters collectively emit light at a predefined variable light-intensity depending upon at least one level of a feeding current supplied by the at least one current source.

Embodiments of the present disclosure, generally, disclose a method of automatically adjusting light intensity of a lighting fixture having multiple emitters includes the steps of providing a power supply for supplying at least one current source to multiple emitters, receiving a feeding current from the at least one current source, distributing the feeding current to at least one first emitter and at least one second emitter, connecting a luminous intensity adjusting circuit to the at least one first emitter for adjusting light intensity of the at least one first emitter, stabilizing a first current flowing through the at least one first emitter, wherein the first current is distributed from the feeding current of the at least one current source and emitting light at a predefined variable light-intensity by multiple emitters collectively depending upon at least one level of the feeding current supplied by the at least one current source.

In another embodiment of the present invention, a system for automatically adjusting light intensity of a lighting fixture having multiple emitters, includes a power supply for supplying at least one current source to multiple emitters, at least one first emitter capable of emitting light of a first wavelength and at least one second emitter capable of emitting light of a second wavelength. Particularly, the at least one first emitter and at least one second emitter are connected at an interconnecting point in a series arrangement and a control circuit for increasing share of a first current distributed from a feeding current of the at least one current source through the at least one first emitter and decreasing share of a second current distributed from the feeding current through the at least one second emitter. Particularly, the control circuit includes an inlet port and an outlet port, the control circuit being connected to the at least one current source at the inlet port to receive the feeding current, and the outlet port of the control circuit being connected to the interconnecting point of the at least one first emitter and at least one second emitter. The multiple emitters includes the at least one first emitter and the at least one second emitter collectively emit light at a predefined variable light-intensity depending upon at least one level of the feeding current supplied by the at least one current source.

In yet another embodiment of the present invention, a method of automatically adjusting light intensity of a lighting fixture having multiple emitters, includes the steps of providing a power supply for supplying at least one current source to multiple emitters, receiving a feeding current from the at least one current source, distributing the feeding current to at least one first emitter and at least one second emitter, connecting the at least one first emitter and the at least one second emitter at an interconnecting point in a series arrangement, connecting a control circuit to the interconnecting point of the at least one first emitter and at least one second emitter and emitting light at a predefined variable light-intensity by multiple emitters collectively depending upon at least one level of the feeding current supplied by the at least one current source.

In accordance with an embodiment of the present invention, the method further includes the steps of inducing a decreased feeding current by a reference voltage source controller, providing a decreased input voltage by the at least one current source to a first switching means Q2 and a second switching means Q3, coupling a first resistance means R22 to the second switching means Q3 for providing current flow through the interconnecting point of the at least one first emitter and the at least one second emitter, generating a larger amount of the feeding current and the feeding current flows through the first resistance means R22 to the at least one first emitter via the interconnecting point, increasing a relative part of a light emitted by the at least one first emitter, emitting aggregated amount of light of reduced light intensity by collecting a first wavelength of the at least one first emitter and a second wavelength of the at least one second emitter and shifting the reduced light intensity of the aggregated amount of light to a first value wavelength.

In accordance with another embodiment of the present invention, the method further includes the steps of connecting a second resistance means (R19) to the at least one second emitter for providing bias voltage to a third switching means (Q4), connecting a third resistance means (R20) to the third switching means (Q4) and a fourth resistance means (R21) to the at least one first emitter for providing flow of the feeding current to the at least one first emitter, providing a decreased input voltage by the at least one current source to a third switching means (Q4) and a fourth switching means (Q5), generating a larger amount of the feeding current and the feeding current flows through the fourth resistance means (R21) to the at least one first emitter via the interconnecting point, increasing a relative part of a light emitted by the at least one first emitter, emitting aggregated amount of light of reduced light intensity by collecting a first wavelength of the at least one first emitter and a second wavelength of the at least one second emitter and shifting the reduced light intensity of the aggregated amount of light to a first value wavelength.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Various embodiments of the present invention provide methods and systems for automatically adjusting light intensity of a lighting fixture having multiple emitters. Moreover, the present invention relates to a method and circuit for automatically adjusting the light-colour of light emitting diodes that collectively emit light at a predefined light-intensity. Particularly, the one or more features of the present invention regulate the lamp and, not only adjust the strength of the light output while being dimmed, but the present invention provide gradual transform of the light emitting diode (LED) from a bright soft-tone colour temperature at the highest level, to a warm flame colour at the lowest dimming level.

In accordance with first preferred embodiment of the present invention, an electrical circuit of the invention has the feature that the at least one first emitter LD1, LD2, LD3, LD4 and the at least one second emitter LD5, LD6, LD7, LD8 are electrically connected in a parallel arrangement. The at least one first emitter LD1, LD2, LD3, LD4 is connected to a luminous intensity adjusting circuit R16-U2 for stabilizing the first current through the at least one first emitter LD1, LD2, LD3, LD4. In this way it is substantially only the second current through the at least one second emitter LD5, LD6, LD7, LD8 that follows the variation of the feeding-current supplied by the current source.

Particularly, it is preferable that the at least one first emitter LD1, LD2, LD3, LD4 has a light-colour which is closer to red in the light-spectrum than the first colour of the at least one second emitter LD5, LD6, LD7, LD8. In operation, when the feeding current is lowered, the at least one first emitter LD1, LD2, LD3, LD4 having the warmer light-colour becomes relatively more important in its contribution to the total light that is emitted by the multiple emitters collectively, than the light that stems from the at least one second emitter LD5, LD6, LD7, LD8 that is more distant in the spectrum from the red area.

In accordance with second preferred embodiment of the present invention, the electrical circuit of the invention has the feature that the at least one first emitter LD5 and the at least one second emitter LD1, LD2, LD3, LD4 are electrically connected in a series arrangement, and the present invention further includes a control circuit 220 for increasing the share of the first current through the at least one first emitter LD5 and/or decreasing the share of the second current through the at least one second emitter LD1, LD2, LD3, LD4 when the level of the feeding-current It is decreased and vice versa.

Figure 1:
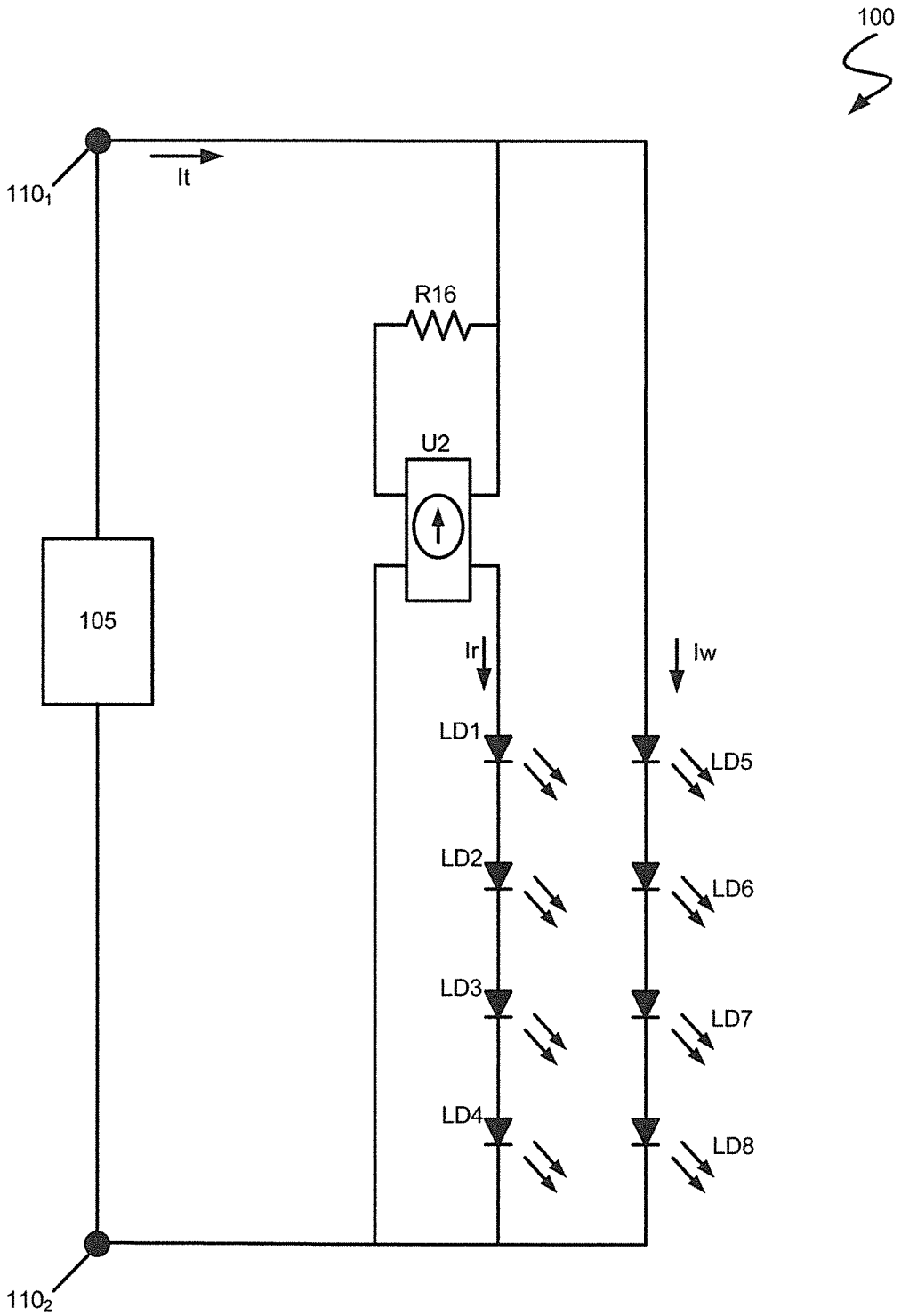
FIG. 1 is a schematic circuit diagram of a system for automatically adjusting light intensity of a lighting fixture having multiple emitters, constructed in accordance with one embodiment of the present invention.

FIG. 1 is a schematic circuit diagram of a system 100 for automatically adjusting light intensity of a lighting fixture having multiple emitters, constructed in accordance with one embodiment of the present invention. The system 100 includes a power supply 105 for supplying at least one current source $\mathbf{110}_1$, $\mathbf{110}_2$ to multiple emitters and the luminous intensity adjusting circuit R16-U2. Particularly the multiple emitters includes, at least one first emitter LD1, LD2, LD3, LD4 capable of emitting light of a first wavelength, and at least one second emitter LD5, LD6, LD7, LD8 capable of emitting light of a second wavelength. The at least one first emitter and at least one second emitter includes at least one light emitting diode (LED).

In operation, the at least one first emitter LD1, LD2, LD3 and LD4 have a first light colour, for instance red and the at least one second emitter LD5, LD6, LD7, LD8 have a second light colour, for instance white. The at least one first emitter LD1, LD2, LD3 and LD4 and the at least one second emitter LD5, LD6, LD7, LD8 are fed by the current originating from a feeding current It, that is supplied by the current source at the points $110_1$ and $110_2$. The luminous intensity adjusting circuit R16-U2 is connected to the at least one first emitter LD1, LD2, LD3 and LD4 for adjusting light intensity of the at least one first emitter LD1, LD2, LD3 and LD4. Particularly, the luminous intensity adjusting circuit R16-U2 stabilizes a first current Ir distributed from the feeding current It of the at least one current source $110_1$, $110_2$. Moreover, the feeding current It is distributed into the first current Ir, which flows through the at least one first emitter LD1, LD2, LD3 and LD4 and into a second current Iw that flows through the at least one second emitter LD5, LD6, LD7, LD8.

In accordance with an embodiment of the present invention, the at least one second emitter LD5, LD6, LD7, LD8 is connected to the at least one first emitter LD1, LD2, LD3 and LD4 in a parallel arrangement.

In accordance with an embodiment of the present invention, the luminous intensity adjusting circuit R16-U2 is configured for stabilizing the first current Ir flowing through the at least one first emitter LD1, LD2, LD3, LD4 at an original level independent of any variation in the feeding current It supplied by the at least one current source $110_1$, $110_2$. Consequently, when the feeding current It is varied, the first current Ir through the at least one first emitter LD1, LD2, LD3, LD4 is maintained at its original level whereas the variation of the feeding current It directly translates into a corresponding variation of the second current Iw through the at least one second emitter LD5, LD6, LD7, LD8. Subsequently, the second current Iw distributed from the feeding current It follows a variation of the feeding current It supplied by the at least one current source $110_1$, $110_2$.

In accordance with an embodiment of the present invention, when the level of the feeding current It diminishes the comparative contribution of the at least one first emitter LD1, LD2, LD3, LD4 in the aggregated amount of light that is emitted by the at least one second emitter LD5, LD6, LD7, LD8 increases, and the light-colour of the aggregated light subsequently emit light at a predefined variable light-intensity depending upon at least one level of a feeding current supplied by the at least one current source $110_1$, $110_2$. Particularly, the aggregated light emitted, shifts to the red part of the light spectrum. This pleases the human eye and is experienced as a natural light behaviour when the light-intensity of the aggregated light emitted by the at least one first emitter LD1, LD2, LD3, LD4 and the at least one second emitter LD5, LD6, LD7, LD8 is reduced.

In accordance with an embodiment of the present invention, a method of automatically adjusting light intensity of a lighting fixture having multiple emitters LD1, LD2, LD3, LD4, LD5, LD6, LD7, LD8 includes the steps of providing the power supply 105 for supplying the at least one current source $110_1$, $110_2$ to multiple emitters LD1, LD2, LD3, LD4, LD5, LD6, LD7, LD8, receiving the feeding current It from the at least one current source $110_1$, $110_2$, distributing the feeding current It to the at least one first emitter LD1, LD2, LD3, LD4 and the at least one second emitter LD5, LD6, LD7, LD8, connecting a luminous intensity adjusting circuit R16-U2 to the at least one first emitter LD1, LD2, LD3, LD4 for adjusting light intensity of the at least one first emitter LD1, LD2, LD3, LD4, stabilizing a first current Ir flowing through the at least one first emitter LD1, LD2, LD3, LD4, wherein the first current Ir is distributed from the feeding current It of the at least one current source $110_1$, $110_2$ and emitting light at a predefined variable light-intensity by the multiple emitters LD1, LD2, LD3, LD4, LD5, LD6, LD7, LD8 collectively depending upon at least one level of the feeding current It supplied by the at least one current source $110_1$, $110_2$.

In accordance with an embodiment of the present invention, the at least one second emitter LD5, LD6, LD7, LD8 is connected to the at least one first emitter LD1, LD2, LD3, LD4 in a parallel arrangement.

In accordance with an embodiment of the present invention, the method further includes the steps of lowering the at least one level of the feeding current It supplied by the at least one current source $110_1$, $110_2$, stabilizing the first current Ir flowing through the at least one first emitter LD1, LD2, LD3, LD4 via the luminous intensity adjusting circuit R16-U2, maintaining the first current Ir flowing through the at least one first emitter LD1, LD2, LD3, LD4 at an original level independent of any variation in the feeding current It supplied by the at least one current source $110_1$, $110_2$, emitting aggregated amount of light of reduced light intensity by collecting a first wavelength of the at least one first emitter LD1, LD2, LD3, LD4 and a second wavelength of the at least one second emitter LD5, LD6, LD7, LD8, and shifting the reduced light intensity of the aggregated amount of light to a first value wavelength.

In accordance with an embodiment of the present invention, the first value wavelength includes a red portion of a visible light spectrum.

In accordance with an embodiment of the present invention, the at least one first emitter LD1, LD2, LD3, LD4 and the at least one second emitter LD5, LD6, LD7, LD8 includes LEDs.

Figure 2:
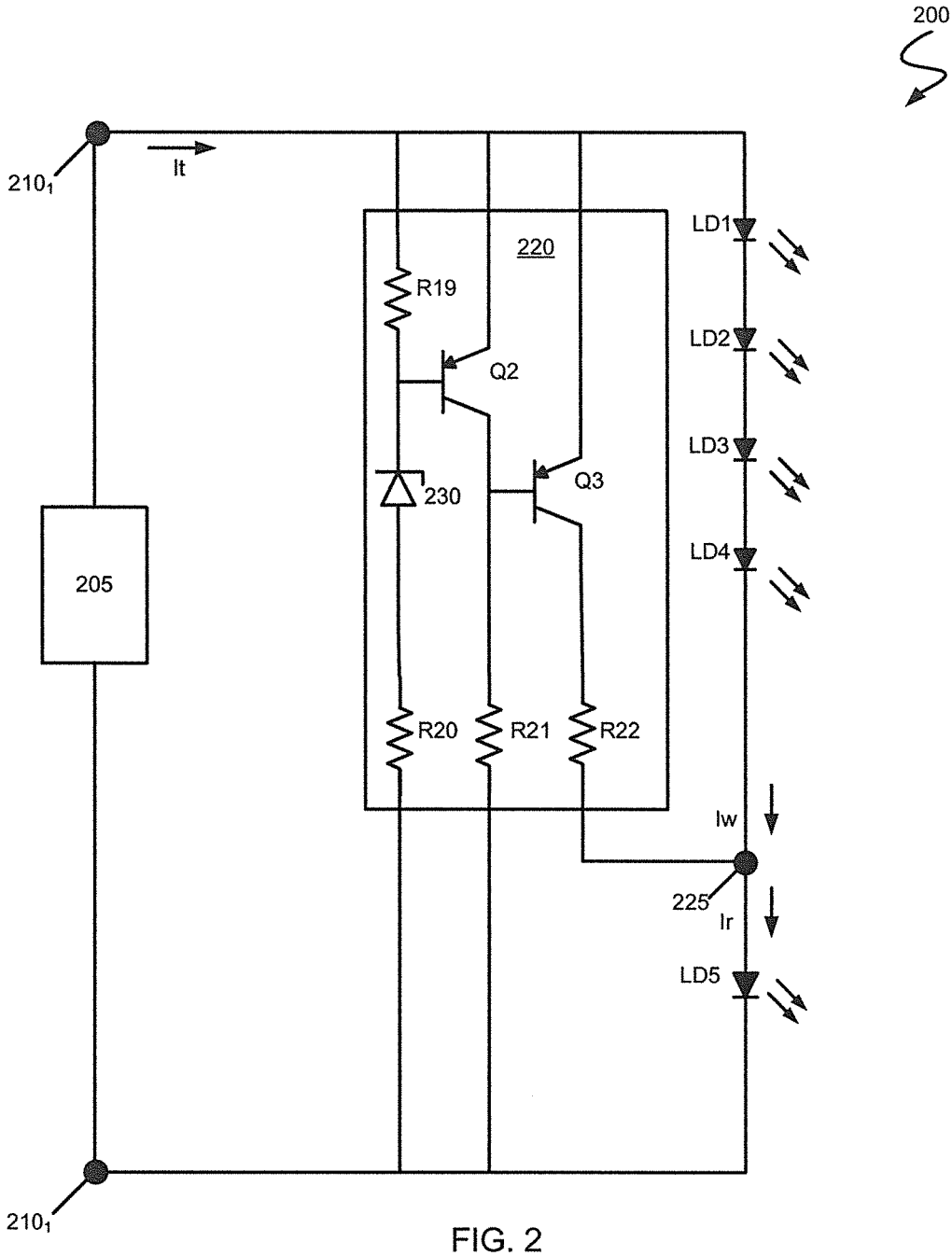
FIG. 2 illustrates a schematic circuit diagram of the system for automatically adjusting light intensity of the lighting fixture having multiple emitters, constructed in accordance with another embodiment of the present invention.

FIG. 2 illustrates a schematic circuit diagram of the system 200 for automatically adjusting light intensity of the lighting fixture having multiple emitters, constructed in accordance with another embodiment of the present invention. The system 200 includes a power supply 205 for supplying at least one current source $210_1$, $210_2$ to multiple emitters. The multiple emitters include at least one first emitter LD5 capable of emitting light of a first wavelength and one or more second emitters LD1, LD2, LD3, LD4 capable of emitting light of a second wavelength. Particularly, the at least one first emitter LD5 and the one or more second emitters LD1, LD2, LD3, LD4 are connected at an interconnecting point 225 in a series arrangement and a control circuit 220 for increasing share of the first current Ir distributed from the feeding current It of the at least one current source $210_1$, $210_2$ through the at least one first emitter LD5 and decreasing share of a second current Iw distributed from the feeding current It through the one or more second emitters LD1, LD2, LD3, LD4. Particularly, the control circuit 220 includes an inlet port and an outlet port. In operation, the control circuit 220 is connected to the at least one current source $210_1$, $210_2$ at the inlet port to receive the feeding current It, and the outlet port of the control circuit 220 being connected to the interconnecting point 225 of the at least one first emitter LD5 and the one or more second emitters LD1, LD2, LD3, LD4.

In accordance with an embodiment of the present invention, the at least one first emitter LD5 is connected to earth and the one or more second emitters LD1, LD2, LD3, LD4 are electrically connected to the at least one current source 210$_1$, 210$_2$ for receiving the second current Iw distributed from the feeding current It.

In accordance with an embodiment of the present invention, the control circuit 220 includes a reference voltage source controller 230 for inducing the feeding current It, a first switching means Q2 being conductive when maximum input voltage is provided by the at least one current source 210$_1$, 210$_2$ and being non-conductive when decreased input voltage is provided by the at least one current source 210$_1$, 210$_2$, a second switching means Q3 being conductive when decreased input voltage is provided by the at least one current source 210$_1$, 210$_2$ and being non-conductive when maximum input voltage is provided by the at least one current source 210$_1$, 210$_2$ and a first resistance means R22 coupled to the second switching means Q3 for providing current flow through the interconnecting point 225 of the at least one first emitter LD5 and the one or more second emitters LD1, LD2, LD3, LD4.

In accordance with an embodiment of the present invention, the reference voltage source controller 230 includes one or more voltage reference devices.

In accordance with an embodiment of the present invention, the voltage reference devices include at least one Zener diode.

In accordance with an embodiment of the present invention, the first switching means Q2 and the second switching means Q3 includes a transistor.

In accordance with an embodiment of the present invention, the at least one first LED LD5 with a first light colour, for instance amber, is placed in series with the one or more second emitters LD1, LD2, LD3, LD4 having a second light colour, in particular white. In operation, the control circuit 220 increases the share of the first current Ir through the at least one first LED LD5 and/or decreases the share of the second current Iw through the one or more second emitters LD1, LD2, LD3, LD4 when the level of the feeding current It is decreased or vice versa.

Particularly, the control circuit 220 secures the feeding current It at its maximum value at the interconnecting point 225 at which the at least one first emitter LD5 is electrically connected with the one or more second emitters LD1, LD2, LD3, LD4. In operation, no current adds up to the second current Iw that flows through the one or more second emitters LD1, LD2, LD3, LD4. This is realized by utilization of the Zener-diode 230, which induces that with the maximum feeding current It present and consequently a maximum voltage is present at the at least one current source 210$_1$, 210$_2$. Subsequently, the transistor Q2 entertains a current in its emitter and collector lines causing the transistor Q3 to be blocked, so that no current will flow in its collector line.

In accordance with an embodiment of the present invention, when the voltage at the at least one current source 210$_1$, 210$_2$ is decreased and consequently the feeding current It is decreased that feeds the first emitter LD5 and the one or more second emitters LD1, LD2, LD3, LD4. Subsequently, this results in a gradual increase of the current flowing through the emitter and collector line of the transistor Q3. Consequently an increasing current will thus flow through the resistor R22 to the interconnecting point 225 that electrically connects to the first emitter LD5 with the first colour. A relatively larger amount of the feeding current It will then flow through the resistor R22 to the first emitter LD5, which is at the cost of the current Iw that flows through the series of the one or more second emitters LD1, LD2, LD3, LD4. The relative part of the light emitted by the first emitter LD5 then increases as compared to the part that stems from the series of the one or more second emitters LD1, LD2, LD3, LD4, and the light colour of the aggregated light that stems from all LEDS LD1-LD5, thus shifts to the red part of the light spectrum.

In accordance with another embodiment of the present invention, a method of automatically adjusting light intensity of a lighting fixture having multiple emitters includes the steps of providing the power supply 205 for supplying at least one current source 210$_1$, 210$_2$ to multiple emitters, receiving the feeding current It from the at least one current source 210$_1$, 210$_2$, distributing the feeding current It to the at least one first emitter LD5 and the at least one second emitter LD1, LD2, LD3, LD4, connecting the at least one first emitter LD5 and the at least one second emitter LD1, LD2, LD3, LD4 at an interconnecting point 225 in a series arrangement, connecting the control circuit 220 to the interconnecting point 225 of the at least one first emitter LD5 and the at least one second emitter LD1, LD2, LD3, LD4 and emitting light at a predefined variable light-intensity by multiple emitters collectively depending upon at least one level of the feeding current It supplied by the at least one current source 210$_1$, 210$_2$.

Particularly, the method further includes the steps of inducing a decreased feeding current It by the reference voltage source controller 230, providing a decreased input voltage by the at least one current source 210$_1$, 210$_2$ to the first switching means Q2 and the second switching means Q3, coupling a first resistance means R22 to the second switching means Q3 for providing current flow through the interconnecting point 225 of the at least one first emitter LD5 and the at least one second emitter LD1, LD2, LD3, LD4, generating a larger amount of the feeding current It and the feeding current It flows through the first resistance means R22 to the at least one first emitter LD5 via the interconnecting point 225, increasing a relative part of a light emitted by the at least one first emitter LD5, emitting aggregated amount of light of reduced light intensity by collecting the first wavelength of the at least one first emitter LD5 and the second wavelength of the at least one second emitter LD1, LD2, LD3, LD4 and shifting the reduced light intensity of the aggregated amount of light to the first value wavelength.

In accordance with an embodiment of the present invention, the first value wavelength includes a red portion of a visible light spectrum.

Figure 3:
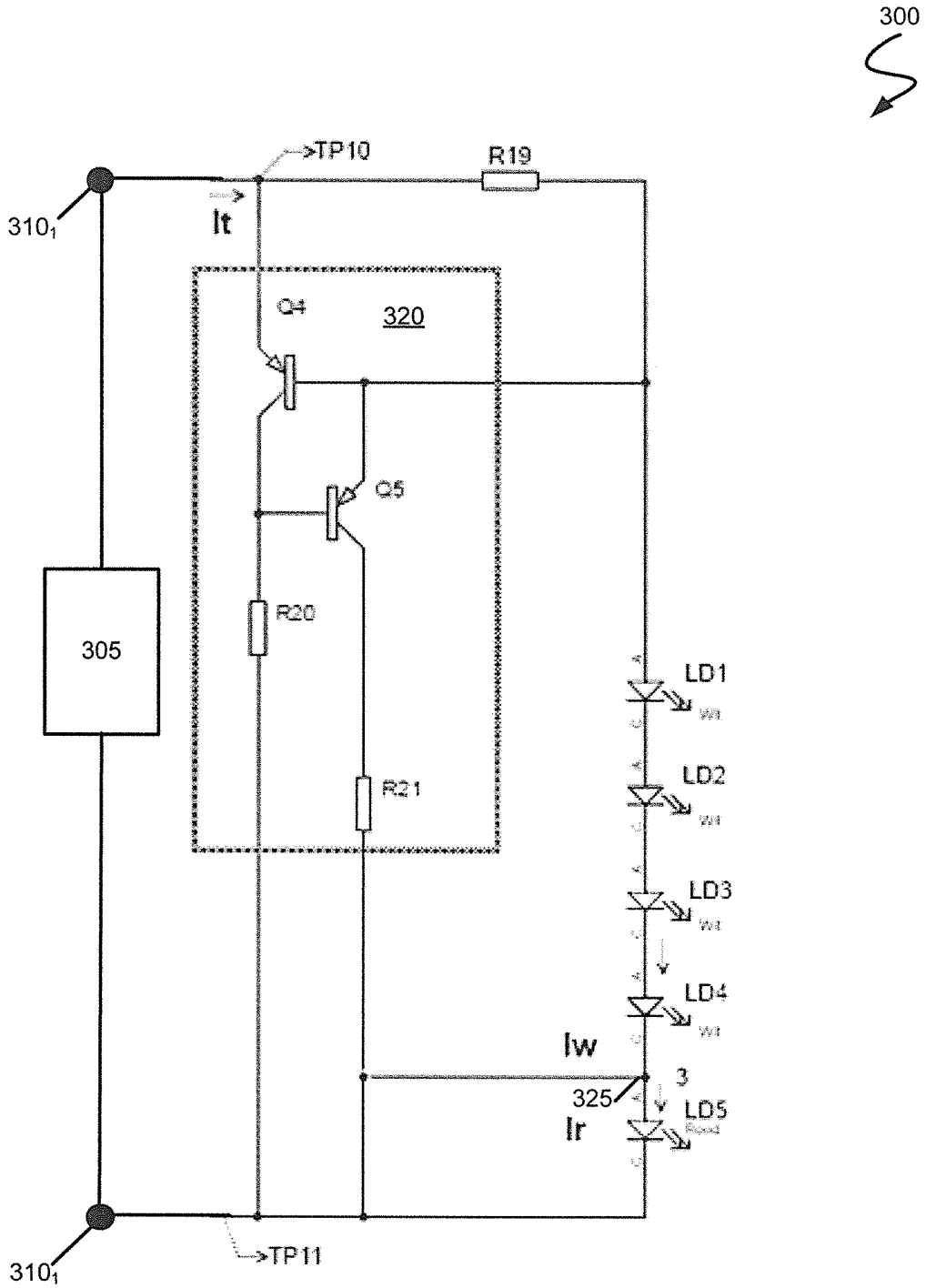
FIG. 3 illustrates a schematic circuit diagram of the system for automatically adjusting light intensity of the lighting fixture having multiple emitters, constructed in accordance with yet another embodiment of the present invention.

FIG. 3 illustrates a schematic circuit diagram of the system 300 for automatically adjusting light intensity of the lighting fixture having multiple emitters, constructed in accordance with yet another embodiment of the present invention. The system 300 includes a power supply 305 for supplying at least one current source 310$_1$, 310$_2$ to multiple emitters. The multiple emitters include at least one first emitter LD5 capable of emitting light of a first wavelength and one or more second emitters LD1, LD2, LD3, LD4 capable of emitting light of a second wavelength. Particularly, the at least one first emitter LD5 and the one or more second emitters LD1, LD2, LD3, LD4 are connected at an interconnecting point 325 in a series arrangement and a control circuit 320 for increasing share of the first current Ir distributed from the feeding current It of the at least one current source 310$_1$, 310$_2$ through the at least one first emitter LD5 and decreasing share of a second current Iw distributed from the feeding current It through the one or more second emitters LD1, LD2, LD3, LD4. Particularly, the control circuit 320 includes an inlet port and an outlet port. In operation, the control circuit 320 is connected to the at least one current source 310$_1$, 310$_2$ at the inlet port to receive the feeding current It, and the outlet port of the control circuit 320 being connected to the interconnecting point 325 of the at least one first emitter LD5 and the one or more second emitters LD1, LD2, LD3, LD4.

In accordance with an embodiment of the present invention, the at least one first emitter LD5 is connected to earth and the one or more second emitters LD1, LD2, LD3, LD4 are electrically connected to the at least one current source $\mathbf{310}_1$, $\mathbf{310}_2$ for receiving the second current Iw distributed from the feeding current It.

In accordance with an embodiment of the present invention, the control circuit 320 includes a second resistance means R19 connected to the one or more second emitters LD1, LD2, LD3, LD4 for providing bias voltage to a third switching means Q4. In operation, the third switching means Q4 is conductive when maximum input voltage is provided by the at least one current source $\mathbf{310}_1$, $\mathbf{310}_2$ and being less conductive when decreased input voltage is provided by the at least one current source $\mathbf{310}_1$, $\mathbf{310}_2$ and a fourth switching means Q5 being conductive when decreased input voltage is provided by the at least one current source $\mathbf{310}_1$, $\mathbf{310}_2$ to the third switching means Q4 and being non-conductive when maximum input voltage is provided by the at least one current source $\mathbf{310}_1$, $\mathbf{310}_2$ to the third switching means Q4.

In accordance with an embodiment of the present invention, a third resistance means R20 is connected to the third switching means Q4 and a fourth resistance means R21 is connected to the at least one first emitter LD5 for providing flow of the feeding current It to the at least one first emitter LD5.

In accordance with an embodiment of the present invention, the third switching means Q4 and the fourth switching means Q5 includes a transistor.

In accordance with an embodiment of the present invention, the at least one first LED LD5 has a first light colour, for instance amber, and is placed in series with the one or more second emitters LD1, LD2, LD3, LD4 having a second light-colour, in particular white. The control circuit 320 increases the share of the first current Ir through the at least one first LED LD5 and/or decreases the share of the second current Iw through the one or more second emitters LD1, LD2, LD3, LD4, when the level of the feeding current It is decreased or vice versa.

In accordance with an embodiment of the present invention, the control circuit 320 secures the feeding current It is at its maximum value that at the interconnecting point 325 at which the at least one first LED LD5 is electrically connected with the one or more second emitters LD1, LD2, LD3, LD4. However, no current adds up to the second current Iw that flows through the series of the one or more second emitters LD1, LD2, LD3, LD4. This is realized by the application of the second resistance means R19, which provides bias voltage to the transistor Q4 as discussed above. Subsequently, the transistor Q4 is turned "ON" and creates a small current It which flows through the emitter and collector leads. Consequently, a lower current flow through the transistor Q4 will be limited by the third resistance means R20, thus causing the transistor Q5 to be blocked, so that no current will flow in its collector line.

When the voltage at the one or more points $\mathbf{310}_1$, $\mathbf{310}_2$ is decreased, consequently the feeding current It is decreased that feeds the series of the at least one first emitter LD5 and the one or more second emitters LD1, LD2, LD3, LD4, and this will subsequently result in a gradual decrease of the current flowing through the emitter and collector line of the transistor Q4. Consequently this will makes the transistor Q5 turn "ON" and allow relatively larger amount of the feeding current It to flow through the at least one first emitter LD5 via the resistor R21. Subsequently, the relative part of the light emitted by the at least one first emitter LD5 then increases as compared to the part that stems from the series of the one or more second emitters LD1, LD2, LD3, LD4 and the light colour of the aggregated light that stems from all LEDS LD1-LD5, thus shifts to the red part of the light spectrum.

In accordance with yet another embodiment of the present invention, the method of automatically adjusting light intensity of a lighting fixture having multiple emitters, includes the steps of connecting a second resistance means R19 to the at least one second emitter LD1, LD2, LD3, LD4 for providing bias voltage to the third switching means Q4, connecting the third resistance means R20 to the third switching means Q4 and the fourth resistance means R21 to the at least one first emitter LD5 for providing flow of the feeding current It to the at least one first emitter LD5, providing a decreased input voltage by the at least one current source $\mathbf{310}_1$, $\mathbf{310}_2$ to the third switching means Q4 and the fourth switching means Q5, generating a larger amount of the feeding current It and the feeding current It flows through the fourth resistance means R21 to the at least one first emitter LD5 via the interconnecting point 325, increasing a relative part of a light emitted by the at least one first emitter LD5, emitting aggregated amount of light of reduced light intensity by collecting a first wavelength of the at least one first emitter LD5 and a second wavelength of the at least one second emitter LD1, LD2, LD3, LD4 and shifting the reduced light intensity of the aggregated amount of light to the first value wavelength. Particularly, the first value wavelength includes the red portion of a visible light spectrum.

Therefore, the present invention provides one or more methods and electrical circuits for automatically adjusting the light-colour of light emitting diodes. The present invention improve the natural feeling experienced when illumination is performed by LEDs, particularly by LEDs that are reduced in their level of light-intensity, such that the light that originates from such light emitting diodes shifts to warmer colours. The invention relates to a method for automatically regulating a lamp, not only to adjust the strength of the light output while being dimmed, but also to gradually transform from a bright soft-tone colour temperature at the highest level, to a warm flame colour at the lowest dimming level. Particularly, in the present implemented methods of the invention the level of the first current is kept constant whilst the level of the second current is varied depending on the level of the light-intensity.

Moreover, the present invention provides an electrical circuit connected to a current source and includes light emitting diodes (LEDs) that in use collectively emit light at a predefined variable light-intensity depending on the level of a feeding-current supplied by the current source. The present invention is unique as it exactly simulates the colour tones of incandescent light bulbs when the LEDs are dimmed.

Furthermore, the invention relates to a method for automatically adjusting the light-colour of light emitting diodes (LEDs), collectively emitting light at a predefined light-intensity, wherein at least one first LED having a first light-colour is applied in combination with at least one second LED having a second light-colour. Particularly, the first light-colour differs from the second light-colour and the first LED and the second LED receive a first current and second current respectively. In operation, the level of said first current and/or said second current is selected depending on the level of said light-intensity. The at least one first LED has a light-colour which is closer to red in the light-spectrum than the light-colour of the at least one second LED.

Accordingly, while there has been shown and described the preferred embodiment of the invention is to be appreciated that the invention may be embodied otherwise than is herein specifically shown and described and, within said embodiment, certain changes may be made in the form and arrangement of the parts without departing from the underlying ideas or principles of this invention within the scope of the claims appended herewith.

The invention claimed is:

1. A system for automatically adjusting light intensity of a lighting fixture having a plurality of emitters, said system comprising:

a power supply for supplying at least one current source to said plurality of emitters;

at least one first emitter capable of emitting light of a first wavelength;

at least one second emitter capable of emitting light of a second wavelength; and a control circuit for increasing share of a first current distributed from a feeding current of said at least one current source through said at least one first emitter and decreasing share of a second current distributed from said feeding current of said at least one current source through said at least one second emitter, wherein said control circuit comprises an inlet port and an outlet port, said control circuit being connected to said at least one current source at said inlet port to receive said feeding current, and said outlet port of said control circuit being connected to said interconnecting point of said at least one first emitter and at least one second emitter, wherein said control circuit comprises:

a resistance means connected to said at least one second emitter for providing bias voltage to a switching means, wherein said switching means being conductive when maximum input voltage is provided by said at least one current source and being less conductive when decreased input voltage is provided by said at least one current source; and another switching means being conductive when decreased input voltage is provided by said at least one current source to said switching means and being non-conductive when maximum input voltage is provided by said at least one current source to said switching means;

wherein said plurality of emitters collectively emit light at a predefined variable light-intensity depending upon at least one level of a feeding current supplied by said at least one current source.

2. The system as claimed in claim 1, wherein said plurality of emitters comprises said at least one first emitter and said at least one second emitter.

3. The system as claimed in claim 1, wherein said at least one second emitter is connected to said at least one first emitter in a parallel arrangement.

4. The system as claimed in claim 1, wherein a luminous intensity adjusting circuit is configured for stabilizing said first current flowing through said at least one first emitter at an original level independent of any variation in said feeding current supplied by said at least one current source.

5. The system as claimed in claim 1, wherein said second current distributed from said feeding current follows a variation of said feeding current supplied by said at least one current source.

6. The system as claimed in claim 1, wherein said at least one first emitter and at least one second emitter comprises at least one light emitting diode (LED).

7. A system for automatically adjusting light intensity of a lighting fixture having a plurality of emitters, said system comprising:

a power supply for supplying at least one current source to said plurality of emitters;

at least one first emitter capable of emitting light of a first wavelength and at least one second emitter capable of emitting light of a second wavelength, wherein said at least one first emitter and at least one second emitter are connected at an interconnecting point in a series arrangement; and a control circuit for increasing share of a first current distributed from a feeding current of said at least one current source through said at least one first emitter and decreasing share of a second current distributed from said feeding current through said at least one second emitter, wherein said control circuit comprises an inlet port and an outlet port, said control circuit being connected to said at least one current source at said inlet port to receive said feeding current, and said outlet port of said control circuit being connected to said interconnecting point of said at least one first emitter and at least one second emitter, wherein said control circuit comprises:

a reference voltage source controller for inducing said feeding current;

a first switching means being conductive when maximum input voltage is provided by said at least one current source and being non-conductive when decreased input voltage is provided by said at least one current source;

a second switching means being conductive when decreased input voltage is provided by said at least one current source and being non-conductive when maximum input voltage is provided by said at least one current source; and a first resistance means coupled to said second switching means for providing current flows through said interconnecting point of said at least one first emitter and said at least one second emitter, and wherein said plurality of emitters comprising said at least one first emitter and said at least one second emitter collectively emit light at a predefined variable light-intensity depending upon at least one level of said feeding current supplied by said at least one current source.

8. The system as claimed in claim 7, wherein said at least one first emitter is connected to earth and said at least one second emitter is electrically connected to said at least one current source for receiving said second current distributed from said feeding current.

9. The system as claimed in claim 7, wherein said reference voltage source controller comprises one or more voltage reference devices.

10. The system as claimed in claim 9, wherein said voltage reference devices include at least one Zener diode.

11. The system as claimed in claim 7, wherein said first switching means and said second switching means comprise a transistor.

12. The system as claimed in claim 7, wherein said control circuit comprises:

a second resistance means connected to said at least one second emitter for providing bias voltage to a third switching means, wherein said third switching means being conductive when maximum input voltage is provided by said at least one current source and being less conductive when decreased input voltage is provided by said at least one current source; and a fourth switching means being conductive when decreased input voltage is provided by said at least one current source to said third switching means and being non-conductive when maximum input voltage is provided by said at least one current source to said third switching means.

13. The system as claimed in claim 12, wherein a third resistance means is connected to said third switching means and a fourth resistance means is connected to said at least one first emitter for providing flow of said feeding current to said at least one first emitter.

14. The system as claimed in claim 12, wherein said third switching means and said fourth switching means comprise a transistor.

15. A method of automatically adjusting light intensity of a lighting fixture having a plurality of emitters, said method comprising the steps of:

providing a power supply for supplying at least one current source to said plurality of emitters;

receiving a feeding current from said at least one current source;

distributing said feeding current to at least one first emitter and at least one second emitter;

connecting a luminous intensity adjusting circuit to said at least one first emitter for adjusting light intensity of said at least one first emitter;

stabilizing a first current flowing through said at least one first emitter, wherein said first current is distributed from said feeding current of said at least one current source;

emitting light at a predefined variable light-intensity by said plurality of emitters collectively depending upon at least one level of said feeding current supplied by said at least one current source;

lowering said at least one level of said feeding current supplied by said at least one current source;

stabilizing said first current flowing through said at least one first emitter via said luminous intensity adjusting circuit;

maintaining said first current flowing through said at least one first emitter at an original level independent of any variation in said feeding current supplied by said at least one current source;

emitting aggregated amount of light of reduced light intensity by collecting a first wavelength of said at least one first emitter and a second wavelength of said at least one second emitter; and shifting said reduced light intensity of said aggregated amount of light to a first value wavelength.

16. The method as claimed in claim 15, said first value wavelength comprises a red portion of a visible light spectrum.

17. The method as claimed in claim 15, wherein said plurality of emitters comprises said at least one first emitter and said at least one second emitter, said at least one second emitter is connected to said at least one first emitter in a parallel arrangement and, said at least one first emitter and at least one second emitter comprises LEDs.

18. The method as claimed in claim 15, wherein said feeding current distributes said first current to said at least one first emitter and a second current to said at least one second emitter.

19. A method of automatically adjusting light intensity of a lighting fixture having a plurality of emitters, said method comprising the steps of:

providing a power supply for supplying at least one current source to said plurality of emitters;

receiving a feeding current from said at least one current source;

distributing said feeding current to at least one first emitter and at least one second emitter;

connecting said at least one first emitter and said at least one second emitter at an interconnecting point in a series arrangement;

connecting a control circuit to said interconnecting point of said at least one first emitter and at least one second emitter;

emitting light at a predefined variable light-intensity by said plurality of emitters collectively depending upon at least one level of said feeding current supplied by said at least one current source;

inducing a decreased feeding current by a reference voltage source controller;

providing a decreased input voltage by said at least one current source to a first switching means and a second switching means;

coupling a first resistance means to said second switching means for providing current flow through said interconnecting point of said at least one first emitter and said at least one second emitter;

generating a larger amount of said feeding current and said feeding current flows through said first resistance means to said at least one first emitter via said interconnecting point;

increasing a relative part of a light emitted by said at least one first emitter;

emitting aggregated amount of light of reduced light intensity by collecting a first wavelength of said at least one first emitter and a second wavelength of said at least one second emitter; and shifting said reduced light intensity of said aggregated amount of light to a first value wavelength.

20. The method as claimed in claim 19, said method further comprises the steps of:

connecting a second resistance means to said at least one second emitter for providing bias voltage to a third switching means;

connecting a third resistance means to said third switching means and a fourth resistance means to said at least one first emitter for providing flow of said feeding current to said at least one first emitter;

providing a decreased input voltage by said at least one current source to a third switching means and a fourth switching means;

generating a larger amount of said feeding current and said feeding current flows through said fourth resistance means to said at least one first emitter via said interconnecting point;

increasing a relative part of a light emitted by said at least one first emitter;

emitting aggregated amount of light of reduced light intensity by collecting a first wavelength of said at least one first emitter and a second wavelength of said at least one second emitter; and shifting said reduced light intensity of said aggregated amount of light to a first value wavelength.

21. The method as claimed in claim 19, said control circuit increases share of a first current distributed from said feeding current of said at least one current source through said at least one first emitter and decreases share of a second current distributed from said feeding current through said at least one second emitter.

22. The method as claimed in claim 19, wherein said control circuit comprises an inlet port and an outlet port, said control circuit being connected to said at least one current source at said inlet port to receive said feeding current, and said outlet port of said control circuit being connected to said interconnecting point of said at least one first emitter and at least one second emitter.

23. The method as claimed in claim 19, said first value wavelength comprises a red portion of a visible light spectrum.

24. The method as claimed in claim 19, wherein said at least one first emitter is connected to earth and said at least one second emitter is electrically connected to said at least one current source for receiving said second current distributed from said feeding current.

25. The method as claimed in claim 19, wherein said at least one first emitter and at least one second emitter comprises LEDs.

* * * * *